United States Patent [19]

Burkemper et al.

[11] 4,426,797

[45] Jan. 24, 1984

[54] SHELF MOLDING

[75] Inventors: Richard L. Burkemper, Manchester, Mo.; Manuel F. Tambrella, Houston, Tex.

[73] Assignee: Creative Data Services, Inc., Maryland Heights, Mo.

[21] Appl. No.: 424,622

[22] Filed: Sep. 27, 1982

[51] Int. Cl.[3] ..... G09F 3/18

[52] U.S. Cl. ..... 40/16.4; 40/584

[58] Field of Search ..... 40/10 R, 16.2, 16.4, 40/584; 40/10, 16, 10 D

[56] References Cited

U.S. PATENT DOCUMENTS

| | | | |
|---|---|---|---|
| 2,856,711 | 10/1958 | Hobbs | 40/16.4 |
| 2,895,241 | 7/1959 | Ferdinand et al. | 40/16.4 |
| 2,950,554 | 8/1960 | Foster | 40/16.2 |
| 3,320,690 | 5/1967 | Forsburg | 40/16.2 |
| 4,334,372 | 6/1982 | Colmar | 40/16.2 |

*Primary Examiner*—Gene Mancene
*Assistant Examiner*—Wenceslao J. Contreras
*Attorney, Agent, or Firm*—Gravely, Lieder & Woodruff

[57] ABSTRACT

A supplemental molding, which is an extruded polymer, snaps onto the conventional molding along the front edge of a display shelf, and holds enlarged shelf labels in an inclined disposition. It is particularly suited for shelves located close to the floor level, for the labels may be read easily without stooping.

9 Claims, 3 Drawing Figures

SHELF MOLDING

BACKGROUND OF THE INVENTION

This invention relates in general to shelving, and more particularly to moldings designed to hold labels on display shelves.

The typical shelf for displaying goods in a supermarket, and in some other stores as well, has a molding fastened to its forward edge, and this molding not only provides an attractive trim along the front of the shelf, but further serves to hold self labels that provide information about the goods on the shelf. Normally the labels are about one inch high and are canted slightly with respect to the vertical. When on shelves at eye level and even on shelves at waist level, the labels are relatively easy to read, but when they are on shelves near floor level they are extremely difficult to read without stooping.

SUMMARY OF THE INVENTION

One of the principal objects of the present invention is to provide a shelf molding for holding larger than normal shelf labels, and for further orienting the labels such that they may be easily observed and read. Another object is to provide a shelf molding of the type stated that holds the label such that it is inclined upwardly. A further object is to provide a molding of the type stated that attaches easily to the conventional molding on a shelf. An additional object is to provide a molding of the type stated which is easy to manufacture as a polymer extrusion. These and other objects and advantages will become apparent hereinafter.

DESCRIPTION OF THE DRAWINGS

In the accompanying drawings which form part of the specification and wherein like numerals and letters refer to like parts wherever they occur.

DETAILED DESCRIPTION

Figure 1:
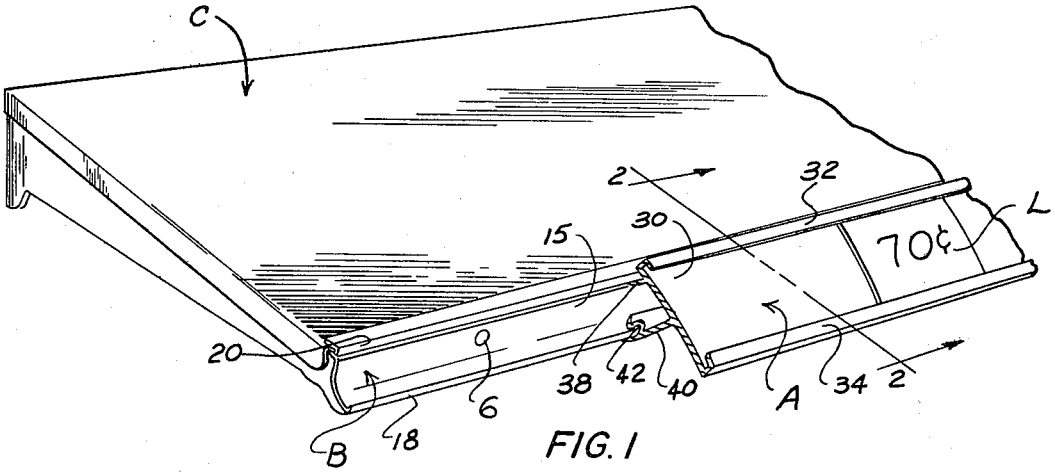
FIG. 1 is a perspective view of a shelf having a conventional shelf molding along its front edge and the supplemental shelf molding of the present invention attached to the conventional molding.

Referring now to the drawings (FIG. 1), a supplemental shelf molding A is designed to fit over a conventional shelf molding B that is supplied with a shelf C of the type designed for holding and likewise displaying merchandise. The shelf C is typical of the type used in supermarkets where several shelves C are arranged one over the other. The conventional moldings B on these shelves C will hold labels that are about one inch high. These labels are relatively easy to read when installed on shelves C at eye level and even on shelves C at waist level, but when the labels installed on shelves C near floor level, they are quite difficult to read without stooping. The supplemental shelf molding A may be engaged with the conventional moldings B of these lower level shelves to hold much larger labels D, and to present those labels at a substantial inclination so that one can read them easily without stooping. Indeed, the molding A is designed to engage the conventional moldings used by several manufacturers of shelving on their display shelves.

To understand the supplemental shelf molding A, requires consideration of the shelf C and its conventional shelf molding B. The shelf C is normally formed from sheet metal which is reinforced and has brackets along its rear edge for engaging an upright support. The shelf C includes a horizontal shelf section 2 and an integral flange 4 which is directed downwardly from the forward margin of the horizontal section 2. The conventional shelf molding B is typically an aluminum extrusion that is attached to the flange 4 of the shelf A by means of rivets 6. The molding B completely obscures the flange 4 and further projects somewhat below it so as to prevent individuals who withdraw items from the next lower shelf from coming in contact with the edge of the flange 4.

Figure 2:
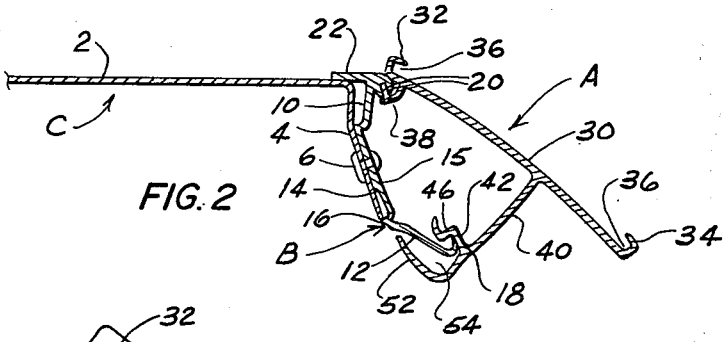
FIG. 2 is a sectional view taken along line 2—2 of FIG. 2 and showing the supplemental molding attached to conventional molding.

The conventional molding B includes (FIG. 2) upper and lower segments 10 and 12, which extend the full length of the molding B and an intermediate segment 14 which is interposed between the upper and lower segments 10 and 12 and likewise extends the full length of the molding B. Indeed the intermediate section 14 along its upper and lower margins merges respectively with the upper and lower segments 10 and 12, and the three segments 10, 12 and 14 together provide a somewhat concave backing surface 15 that is presented outwardly away from the shelf A. At the juncture of the lower and intermediate segments 12 and 14 a slight rib 16 projects rearwardly. Along the lower edge of the lower segment 12 is a small lip 18 that is turned upwardly so that a shallow groove exists between the lip 18 and the lower section 12. Along the upper edge of the upper segment 10 are a pair of small downwardly directed lips 20 that are closely spaced and provide a shallow groove which opens downwardly toward the groove along the lower lip 18. In addition, the upper segment 10 along its upper edge merges into a rearwardly directed flange 22. The upper surface of the flange 22 is flat and continues over the two upper lips 20 so as to provide an attractive flat surface along the top of the molding B.

The intermediate segment 14 fits against the front face of the shelf flange 4, and when the molding B is properly positioned, the flange 22 overlies and rests on the horizontal shelf section 2 immediately rearwardly from the flange 4. Also, the slight rib 16 lies immediately beneath the lower edge of the shelf flange 4. The rivets 6 extend through the intermediate section 14 and likewise through the shelf flange 4, beyond which they are upset to permanently secure the conventional molding B on the shelf C.

Thus, the concave backing surface 15 formed by the upper, lower, and intermediate sections 10, 12 and 14 is normally exposed and presented forwardly, with the lower lip 18 set slightly ahead of the upper lips 20. A shelf label of traditional size is easily inserted into the molding B merely by bending it slightly along its longitudinal axis and inserting its upper and lower edges into the grooves along the upper and lower lips 18 and 20. Then the center portion of the label is deflected rearwardly until the label lies against the concave surface 15 formed by the three joined together segments 10, 12 and 14. While the label is presented at a slight inclination, it is still difficult to read by one standing erect, if the label is on a shelf C close to floor level. The supplemental molding A, when installed on the conventional molding B, eliminates this problem.

The supplemental molding A is formed in its entirety from a material that is somewhat flexible, and preferably from a polymer such as polyvinyl chloride. Since the molding A has uniform cross-sectional configuration, it may be produced as an extrusion. The supplemental molding A snaps onto the conventional molding B, engaging the conventional molding B at its upper and lower lips 18 and 20 that are normally utilized to retain the traditional small labels.

Figure 3:
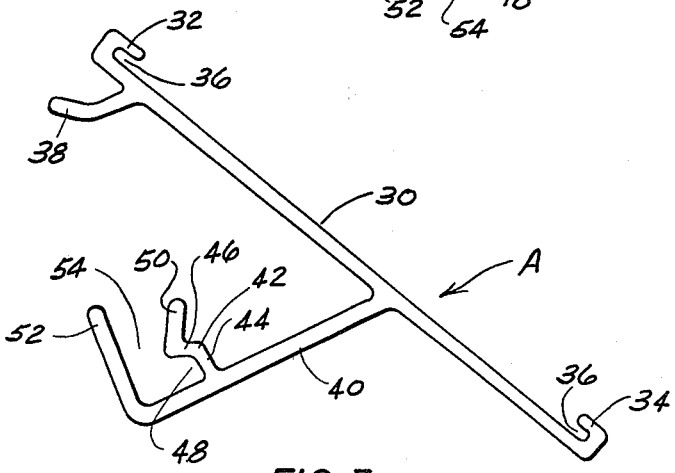
FIG. 3 is a sectional view of the supplemental molding only, showing it in an undeflected condition.

The supplemental molding A includes (FIGS. 2 & 3) a display panel 30 that is flat and may be about twice as high as the traditional shelf label or for that matter any other size that is desired. Along its upper edge the display panel 30 has a downwardly directed lip 32, while along its lower edge it has an upwardly directed lip 34. Both lips 32 and 34 are spaced forwardly a slight distance from the front face of the panel 30 so as to create opposing grooves 36 along the upper and lower edges of the panel 30. The grooves 36 are quite shallow and are wide enough to receive the edge of the type of sheet material on which shelf labels are normally printed.

Near the upper edge of the display panel 30, a retaining rib 38 projects rearwardly from the rear face of the display panel 30, with the included angle between the rib 38 and the panel 30 being an acute angle of perhaps 60°. The amount of display panel 30 that is above the rib 38 should normally be only slightly greater than the height of the small upper lip 20 on the conventional shelf molding B. Moreover, the retaining rib 38 is slightly curved, with its concaved surface being presented upwardly. Its depth, that is the extent of its rearward projection, should be only slightly greater than the width of the two lips 20 on the conventional shelf molding B, so that the retaining rib 38 may fit under those lips 20.

Below the retaining rib 38, and indeed generally midway between the rib and the lower edge of the panel 30, a positioning web 40 projects rearwardly from the display panel 30 for a substantially greater distance than the retaining rib 38, which is relatively short. The web 40, in further contrast to the retaining rib 38, is planar and is inclined with respect to the panel 30, the included angle between the two being about 66°. The web 40 has a lower retaining rib 42 projected generally upwardly from it, and this rib includes a base segment 44 that projects from the web 40 at a right angle and is directed toward the upper retaining lip 38. The rib 42 also includes a laterally directed segment 46 that projects reawardly and creates an undercut 48 between it and the web 40. The undercut 48 is high enough and deep enough to accommodate the lower lip 18 on the conventional molding B. Finally, the lower retaining rib 42 has an edge segment 50 which projects from the end of the laterally directed segment 46 toward the back of the display panel 30.

The positioning web 40 continues beyond the base segment 44 of the lower retaining rib 42, and at its end merges into a backing flange 52 that projects upwardly from the web 40 at approximately 90°, the extent of its projection being slightly greater than that of the lower retaining rib 42. Even so, the flange 52 in terms of the extent of its projection from the web 40 is shorter than the lower segment 12 on the conventional molding B. The flange 52 and lower locking rib 42 create an upwardly opening groove 54 at the end of the positioning web 40, and this groove in its narrowest region is slightly wider than the lower segment 12 of the conventional molding B at the lip 18 thereon, so that the groove 54 will receive the lower segment 12 of the conventional molding B. Indeed, when the lower segment 12 is fully received in the groove 54, the small lip 18 will locate opposite to and will project into the undercut 48 that opens into the groove 54.

To install the supplemental molding A on the conventional molding B, the groove 54 at the end of the web 40 on the former is aligned with the lower segment 12 of the latter. In this regard, it will be recalled that the lower segment 12 of the conventional molding B projects downwardly beyond the lower edge of the flange 4 at the end of the shelf C, and as a consequence the lower segment 12 is exposed on both its forwardly and rearwardly presented surfaces. The supplemental molding A is then thrust upwardly, in which case the backing flange 52 moves upwardly to the rear of the lower segment 12, while the lower retaining rib 42 moves upwardly in front of the lip 18 on the lower segment 12. At the same time, the upper retaining rib 38 will pass upwardly in front of the lips 20 along the upper segment 10 of the conventional molding B and will come to rest over the flat upper surface of the flange 22. When the supplemental molding A is so disposed, the laterally directed segment 46 of the lower retaining rib 42 for the molding A projects over the upper edge of the lip 18 on the lower segment 12 of the conventional molding B. Indeed, the lower lip 18 of the conventional molding B is received in the undercut 48 along the lower retaining rib 42 of the supplemental molding A.

Next, the supplemental molding A is deflected in the region of its display panel 30 and positioning web 40 by forcing its upper edge downwardly until the free end of the upper retaining rib 38 is beneath the two lips 20 at the upper end of the conventional molding B. At this point, the entire supplemental molding A is rocked rearwardly on the lower lip 18 of the conventional molding B, so as to position the upper retaining lip 38 beneath the pair of lips 18 along the upper margin of the conventional molding B. In this regard, the laterally directed segment 46 of the lower retaining rib 42 on the molding A, inasmuch as it is positioned over the lower lip 18 of the conventional molding B, prevents the supplemental molding A from shifting downwardly, and as a consequence the molding A must be deflected in the region of its panel 30 and web 40 in order to bring the upper retaining rib 38 to a position low enough to force it under the upper lips 20 of the conventional molding B. When the molding A is so deflected, the material of the molding A is, of course, stressed, but the stress is not beyond the elastic limits of the material.

When the deflected molding A is released, its natural resiliency drives the upper retaining rib 38 against the pair of lips 20 along the upper edge of the conventional molding B, thereby tightly securing the supplemental molding A to the conventional molding B. The backing flange 52 for the supplemental molding A is disposed behind the lower segment 12 of the conventional molding B, and indeed bears against the backside of the lower segment 12. This prevents the laterally directed segment 46 of the lower locking rib 42 from sliding forwardly and disengaging from the lower lip 18 of the conventional molding B.

As an alternative procedure for installing the supplemental molding A, both the upper retaining rip 38 and the groove 54 behind the lower retaining rib 42 for the molding A may be aligned respectively with the pair of upper lips 20 and the lower segment 12 of the conventional molding B. With the upper retaining rib 38 for the molding A bearing against the lower ends of the two lips 20 on the upper segment 10 of the conventional molding B, the web 40 in the region of the lower locking rib 42 and flange 52 is forced upwardly. As the end of the laterally directed segment 46 for the retaining rib 42 passes over the lower lip 18 of the conventional molding B, the lower retaining rib 42 and backing flange 52 will spread slightly, but once the laterally directed segment 46 passes the lower lip 18 of the conventional molding B, the lower rib 42 will snap over the lower lip 18 of the conventional molding B so that lip 18 is received in the undercut 48. Again, the natural resiliency of the material from which the supplemental molding A is formed causes its upper retaining rib 38 and lower retaining rib 42 to bear respectively against the upper and lower lips 20 and 18 of the conventional molding B.

In short, the supplemental molding A snaps into engagement with the conventional molding B, with the securement being in the regions of the two retaining ribs 38 and 42. When the supplemental molding is so engaged, its display panel 30 is presented at about 45°. Large labels L are fitted into the supplemental molding A directly in front of the merchandise to which they refer. The labels L are perhaps most easily installed by bending them slightly and inserting their upper and lower edges into the grooves 36 behind the upper and lower lips 32 and 34. Then, the labels L are flattened out against the forward face of the display panel 30. Since the labels L lie directly over the display panel 30, they too are disposed at the 45° angle and are easily read by one standing erect over them.

This invention is intended to cover all changes and modifications of the example of the invention herein chosen for purposes of the disclosure which do not constitute departures of the spirit and scope of the invention.

What is claimed is:

1. In combination with a shelf to which an attached shelf molding is fastened, the shelf molding having a generally upright backing surface, a downwardly turned lip located along the upper margin of the backing surface and spaced forwardly from that surface, and an upwardly turned lip located along the lower margin of the backing surface and likewise spaced forwardly from that surface, the lips forming grooves along the upper and lower margins of the backing surface for retaining shelf labels against the backing surface; a supplemental shelf molding fitted to the attached shelf molding for displaying labels at an inclination different from that afforded by the attached molding, said supplemental shelf molding comprising: a display panel; means along the display panel for holding a shelf label against the display panel; an upper retaining rib extending rearwardly from the display panel and located beneath the downwardly turned lip at the upper margin of the attached molding; a positioning web extended rearwardly from the display panel below the upper retaining rib and passing beneath the upwardly turned lip on the attached molding; a lower retaining rib projecting upwardly from the positioning web and being located generally in front of the upwardly turned lip of the attached molding, the lower retaining rib having a laterally directed segment which overlies the upwardly directed lip on the attached molding; and a backing flange also projected upwardly from the positioning web and located rearwardly from the lower retaining rib and behind the lower portion of the attached shelf molding, whereby a groove exists between the lower retaining rib and the backing flange, with the groove being wide enough to receive the lower portion of the attached shelf molding; the supplemental shelf molding between its upper and lower retaining ribs being deflected within the elastic limits of the material from which the supplemental molding is formed such that the upper retaining rib bears snugly against the downwardly directed lip of the attached molding and the laterally directed segment of the lower retaining rib bears snugly against the upwardly directed lip on the attached molding.

2. The combination according to claim 1 wherein the display panel and positioning web are substantially planar, and the web is disposed at an oblique angle with respect to the panel.

3. The combination according to claim 1 wherein the display panel, the upper retaining rib, the positioning rib, the lower retaining rib and the flange are all formed integral with each other.

4. The combination according to claim 1 wherein the laterally directed segment of the lower retaining rib forms an undercut along the lower retaining rib, and the upwardly directed lip of the attached molding is received in that undercut.

5. The combination according to claim 4 wherein the backing flange projects farther from the positioning web than the height of the undercut in the lower retaining rib.

6. The combination according to claim 1 wherein the means along the display panel for holding a shelf label against the display panel includes upper and lower lips located parallel to each other along the panel and spaced forwardly from the panel such that grooves exist between the lips and the panel.

7. The combination according to claim 1 wherein the upper retaining rib is located below the upper margin of the display panel and the positioning web is located above the lower margin of the display panel.

8. A shelf molding comprising a display panel having a generally flat forwardly presented surface; lips creating grooves at the upper and lower edges of the display panel for receiving the upper and lower edges of a shelf label; an upper retaining rib projecting rearwardly from the display panel; a web projecting rearwardly from the display planel below the upper retaining lip; and a lower retaining rib projecting generally upwardly from the web and toward the upper retaining rib, the lower rib having a laterally directed portion that is extended in generally the same direction as the upper rib and forms a rearwardly opening undercut along the lower rib, and a backing flange projecting upwardly from the positioning web beyond the lower retaining rib a distance greater than the height of the undercut in the lower retaining rib, all such that a groove exists between the lower rib and the flange and the undercut in the lower retaining rib opens into that groove, the web and panel being flexible between the two ribs.

9. A molding according to claim 8 wherein the upper retaining rib and positioning web are generally parallel and are further oblique to the display panel.

* * * * *